United States Patent [19]

Rodd

[11] Patent Number: 4,535,934

[45] Date of Patent: Aug. 20, 1985

[54] HOT WATER HEAT DISTRIBUTOR

[76] Inventor: Derek E. Rodd, 20 Hemlock Way, San Geronimo, Calif. 94963

[21] Appl. No.: 607,424

[22] Filed: May 7, 1984

Related U.S. Application Data

[63] Continuation-in-part of Ser. No. 339,306, Jan. 15, 1982, Pat. No. 4,498,623.

[51] Int. Cl.[3] ..... F24H 3/00

[52] U.S. Cl. ..... 237/70; 165/142

[58] Field of Search ..... 237/70, 56; 165/55, 165/142

[56] References Cited

U.S. PATENT DOCUMENTS 2,532,550 12/1950 Hobbard ..... 237/67

4,147,302 4/1979 Gray ..... 237/9 R 4,315,598 2/1982 Madigan ..... 237/70

*Primary Examiner*—Henry Bennett

*Attorney, Agent, or Firm*—Melvin R. Stidham

[57] ABSTRACT

A heat distributing unit comprising a pair of inner and outer concentric pipes with a valve connected at one end. The valve has separate inlet and outlet lateral flow ports so that circulation from the inlet port goes through the annular space between the inner and outer pipes to the opposite ends thereof and, with the outer pipe being closed and the inner pipe being open at that end, there is reverse circulation back through the inner pipe to the outlet port of the valve. A thermal responsive valve controls the amount of circulation in response to heat and closes off circulation when a predetermined temperature is reached.

3 Claims, 2 Drawing Figures

HOT WATER HEAT DISTRIBUTOR

RELATED INVENTION

This is a continuation-in-part of my co-pending application Ser. No. 339,306 filed Jan. 15, 1982 now U.S. Pat. No. 4,498,623 for "Hot Water Heating System".

BACKGROUND OF THE INVENTION

This invention relates to a hot water heating system of the general type disclosed in British Pat. Nos. 1,180,462 and 1,180,463. In previous systems a plurality of heat distributing units are arranged in a room or group of rooms to be heated and hot water is passed through them in series to heat each in sequence. Unless suitable Tees or bypasses are installed, no individual unit can be closed off without shutting down the entire system. In the aforesaid British patents, hot water is circulated from a manifold through each radiator or convector and then back to the manifold for return to the boiler. Each radiator or convector is equipped with a valve so that circulation through each individual unit may be restricted or shut off completely. However, where low water content boilers are used as the heat source, it is necessary to have flow through at least one unit so as to provide for circulation back to the pump to prevent damage to the pump as well as to the boiler.

OBJECTS OF THE INVENTION

It is, therefore, an object of this invention to provide a hot water heating system wherein each heat distributing unit can be closed off as required.

It is a further object of this invention to provide a hot water heating system comprising a plurality of heat distributing units, each connected to a manifold, and each controlled by a thermostatic valve that may be closed off irrespective of the operation of other units.

It is a further object of this invention to provide a hot water heat distributing unit through which hot water flows bi-directionally, both from and back to the supply.

It is a further object of this invention to provide a hot water heating system comprising a plurality of heat distributing units through which water is pumped from and to a manifold in reverse circulation.

It is a further object of this invention to provide a hot water heating system wherein there is constant circulation of water even though all of the heat distributing units have been closed, as by temperature responsive valves.

Other objects and advantages of this invention will become apparent from the description to follow, particularly when read in conjunction with the accompanying drawing.

SUMMARY OF THE INVENTION

In carrying out this invention, I provide a plurality of heat distributing units, each of which is connected to the upstream and downstream side of a distributing manifold, such upstream and downstream sides being separated by a dividing partition. Each distributing unit is of dual pipe configuration, with water being circulated from the inlet through an outer pipe and then back through the inner pipe to the outlet. The flow capacity of each heat distributing unit is controlled by a temperature-responsive valve so that circulation is stopped when a desired temperature is reached. An orifice through the partition dividing the upstream and downstream sides of the manifold provides some circulation even though the valves of all distributing units are closed.

DESCRIPTION OF A PREFERRED EMBODIMENT

Figure 1:
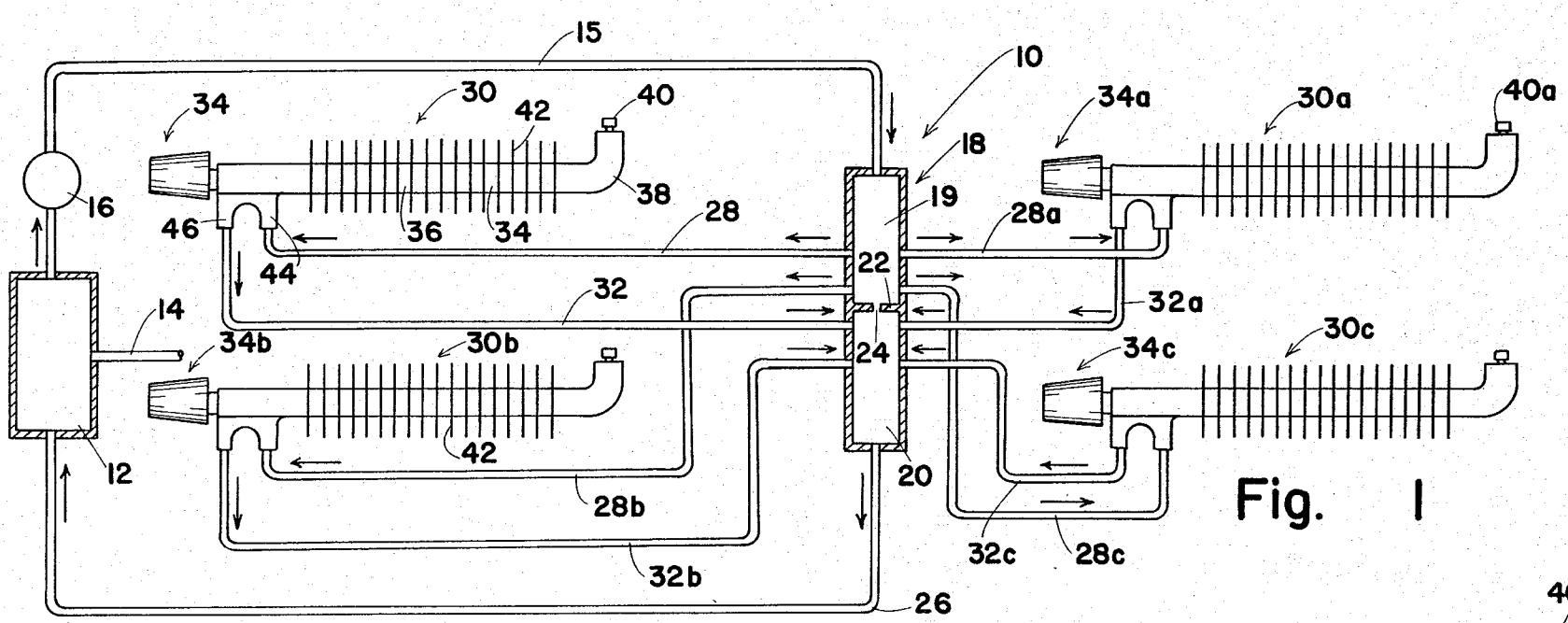
FIG. 1 is a schematic view of the hot water heating system of this invention.

Referring now to FIG. 1 with greater particularity, the hot water heating system 10 of this invention includes a suitable water heater 12, which is supplied with water from a feed line 14, such as a residential water line. Hot water from the heater 12 is delivered by pump 16 to a manifold 18 having supply and return compartments 19 and 20, which are separated by a partition 22 with an orifice 24 therethrough, for a purpose hereinafter to be described. From the downstream side 20 of the manifold 16 the cooled water is delivered through line 26 back to the boiler or heater 12 for re-circulation.

From the upstream or supply side 19 of the manifold 18 supply lines 28, **28*a*, 28*b*, and 28*c* deliver hot water to each of a plurality of radiators or convectors 30, 30*a*, 30*b*, and 30*c*. Return lines 32, 32*a*, 32*b*, and 32*c* deliver the now-cooled water back to the downstream side 20 of the manifold 18 for return through line 26 to the boiler 10**, as previously described.

Each of the heat distributing units 30, **30*a*, 30*b*, and 30*c* is controlled by a thermostatic valve 34, 34*a*, 34*b*, and 34*c*, as described in my aforesaid co-pending application. In the event that all of such valves are closed, some circulation is allowed to continue through the orifice 24 in the partition 22 of the manifold 18 to avoid damage to the pump 16 and boiler 12**.

Figure 2:
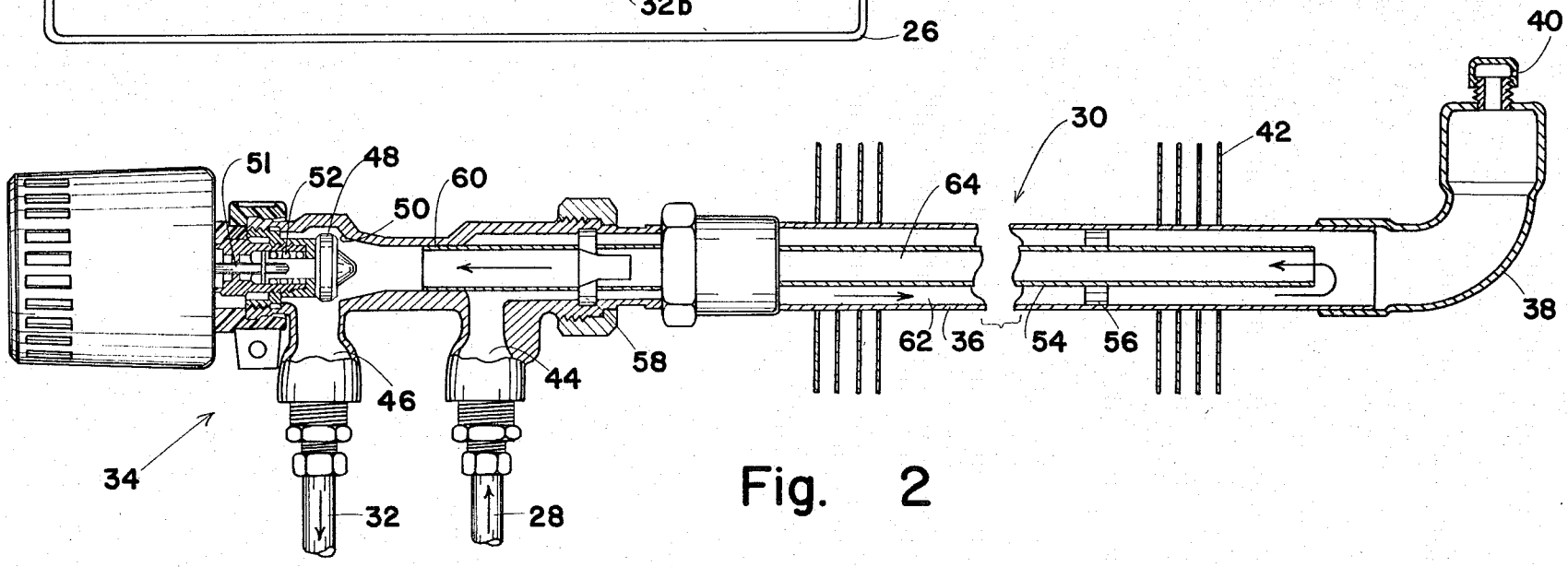
FIG. 2 is a vertical section view of a heat distributing unit forming a significant component of the system.

Referring now to FIG. 2 with greater particularity, each of the heat distributing units, such as unit 30, comprises essentially an elongated, large diameter pipe 36 with the temperature-responsive valve 34 at one end and an elbow 38 with a bleed valve 40, through which entrapped air may be bled, at the other. Surrounding the pipe 36 is a plurality of fins 42 of thin metal or the like to maximize convection of heat into the environment.

The valve 34 includes lateral inlet and outlet ports or taps 44 and 46 and a temperature-controlled plug or the like 48 that partially closes or shuts off a valve seat 50 with increases in temperature, by expansion of a thermal-responsive member 51 against the action of a spring 52.

A smaller diameter inner pipe 54 is centered within the outer pipe 36 by suitable means, such as spiders 56 and 58 and is welded at 60 between the inlet and outlet taps 44 and 46 to isolate an annular outer flow passage 62 from an inner, return passage 64 through the small pipe 54.

In operation, hot water is circulated from the manifold 18 through inlet pipe 28, inlet passages 44 and through the outer, annular flow passage 62 within the large pipe 36 and then, as indicated by the arrows, back through the inner pipe passage 64 and outlet port 50 to the oulet passage 46. From the outlet port 46 the relatively cool water is directed through duct 32 back to the manifold 18, as previously described.

The reverse circulation provided by the concentric pipes 36 and 54 enables the hot water to circulate twice through each heat distributing unit 30, 30*a*, 30*b* and 30*c* and enables each heat distributing unit to be closed off separately, irrespective of the amount of flow through other units, with some circulation being assured by the orifice 24 in the partition 22.

While this invention has been described in conjunction with a preferred embodiment thereof, it is obvious that modifications and changes therein may be made by those skilled in the art to which it pertains, without departing from the spirit and scope of this invention, as defined by the claims appended hereto.

What is claimed as invention is:

1. For a water heating system, a reverse circulation heat distributing unit comprising:

a pair of inner and outer pipes;

heat transfer fins on said outer pipe;

a valve body connected to said outer pipe at one end thereof;

means closing off the other end of said outer pipe;

inlet and outlet flow ports opening laterally, respectively, to and from said valve body;

a longitudinal passageway in said valve body extending between said flow ports;

means sealing one end of said inner pipe in and around said passageway;

the other end of said inner pipe being open;

said inlet flow port being closer to said outer pipe than said outlet flow port so that water is circulated to said other end of the outer pipe around said inner pipe and then back through said inner pipe to said outlet flow port;

a valve seat around one end of said passageway; and a valve closure member engageable with said valve seat to shut off flow from said outlet port.

2. The heat distributing unit defined by claim 1 wherein:

said valve closure member is thermal-responsive to move toward said valve seat with increases in temperature.

3. The heat distributing unit defined in claim 1 including:

means centering said inner pipe within said outer pipe so as to be substantially coaxial therewith.

* * * * *